US011377780B2

(12) United States Patent
Del Puppo et al.

(10) Patent No.: US 11,377,780 B2
(45) Date of Patent: Jul. 5, 2022

(54) METHOD TO CONTROL OPERATION OF A LAUNDRY DRYER

(71) Applicant: Electrolux Appliances Aktiebolag, Stockholm (SE)

(72) Inventors: Marco Del Puppo, Porcia (IT); Davide Sillo, Porcia (IT); Roberto Ragogna, Porcia (IT); Christian Zavan, Porcia (IT)

(73) Assignee: Electrolux Appliances Aktiebolag

( * ) Notice: Subject to any disclaimer, the term of this patent is extended or adjusted under 35 U.S.C. 154(b) by 250 days.

(21) Appl. No.: 16/630,616

(22) PCT Filed: Jul. 14, 2017

(86) PCT No.: PCT/EP2017/067862
§ 371 (c)(1),
(2) Date: Jan. 13, 2020

(87) PCT Pub. No.: WO2019/011443
PCT Pub. Date: Jan. 17, 2019

(65) Prior Publication Data

US 2020/0157731 A1 May 21, 2020

(51) Int. Cl.
*F26B 7/00* (2006.01)
*D06F 58/38* (2020.01)
(Continued)

(52) U.S. Cl.
CPC ..... *D06F 58/38* (2020.02); *D06F 34/05* (2020.02); *D06F 34/28* (2020.02); *D06F 58/206* (2013.01);
(Continued)

(58) Field of Classification Search
CPC ..... D06F 58/38; D06F 58/206; D06F 34/05; D06F 34/28; D06F 2101/10;
(Continued)

(56) References Cited

U.S. PATENT DOCUMENTS 10,294,605 B2 5/2019 Cavarretta et al.
2009/0071032 A1* 3/2009 Kreutzfeldt ..... D06F 58/44 34/389
(Continued)

FOREIGN PATENT DOCUMENTS

CN 101473085 A 7/2009
CN 103184673 A 7/2013
(Continued)

OTHER PUBLICATIONS

International Search Report and Written Opinion for International Application No. PCT/EP2017/067862, dated Sep. 27, 2017, 9 pages.
(Continued)

*Primary Examiner* — John P McCormack
(74) *Attorney, Agent, or Firm* — RatnerPrestia

(57) ABSTRACT

A method to control operation of a laundry dryer. The method includes starting a drying cycle, and receiving a user input command through one of a first interface and a second interface. If the command is provided through the first interface, a first working routine is started. If the same command is provided through the second interface, a second working routine is started. The second routing is different in at least one operational parameter than the first working routine. A laundry dryer configured to perform the method is also provided.

21 Claims, 5 Drawing Sheets

(51) Int. Cl.

| | |
|---|---|
| *D06F 105/48* | (2020.01) |
| *D06F 103/38* | (2020.01) |
| *D06F 101/20* | (2020.01) |
| *D06F 105/56* | (2020.01) |
| *D06F 105/30* | (2020.01) |
| *D06F 34/28* | (2020.01) |
| *D06F 103/04* | (2020.01) |
| *D06F 103/06* | (2020.01) |
| *D06F 103/24* | (2020.01) |
| *D06F 103/32* | (2020.01) |
| *D06F 105/14* | (2020.01) |
| *D06F 105/28* | (2020.01) |
| *D06F 105/52* | (2020.01) |
| *D06F 34/05* | (2020.01) |
| *D06F 101/10* | (2020.01) |
| *D06F 101/14* | (2020.01) |
| *D06F 101/18* | (2020.01) |
| *D06F 58/20* | (2006.01) |

(52) U.S. Cl.

CPC ..... *D06F 2101/10* (2020.02); *D06F 2101/14* (2020.02); *D06F 2101/18* (2020.02); *D06F 2101/20* (2020.02); *D06F 2103/04* (2020.02); *D06F 2103/06* (2020.02); *D06F 2103/24* (2020.02); *D06F 2103/32* (2020.02); *D06F 2103/38* (2020.02); *D06F 2105/14* (2020.02); *D06F 2105/28* (2020.02); *D06F 2105/30* (2020.02); *D06F 2105/48* (2020.02); *D06F 2105/52* (2020.02); *D06F 2105/56* (2020.02)

(58) Field of Classification Search

CPC ..... D06F 2101/14; D06F 2101/18; D06F 2101/20; D06F 2103/04; D06F 2103/06; D06F 2103/24; D06F 2103/32; D06F 2103/38; D06F 2105/14; D06F 2105/28; D06F 2105/30; D06F 2105/48; D06F 2105/52; D06F 2105/56

USPC ..... 34/427

See application file for complete search history.

(56) References Cited

U.S. PATENT DOCUMENTS

| | | | | |
|---|---|---|---|---|
| 2013/0167398 | A1 | 7/2013 | Lee et al. | |
| 2013/0214935 | A1* | 8/2013 | Kim | H04L 12/2816 340/870.02 |
| 2015/0322618 | A1* | 11/2015 | Bisaro | D06F 58/34 62/79 |

FOREIGN PATENT DOCUMENTS

| | | | |
|---|---|---|---|
| CN | 104420145 | A | 3/2015 |
| CN | 104838057 | A | 8/2015 |
| CN | 104870710 | A | 8/2015 |
| CN | 104884701 | A | 9/2015 |
| CN | 104919109 | A | 9/2015 |
| DE | 102014214836 | A1 | 2/2016 |
| EP | 2630904 | A1 | 8/2013 |
| EP | 2733252 | A1 | 5/2014 |
| EP | 2733253 | A1 | 5/2014 |
| EP | 2733256 | A1 | 5/2014 |

OTHER PUBLICATIONS

Chinese Office Action for Chinese Application No. 201780093036.0, dated May 8, 2021, 13 pages.

* cited by examiner

METHOD TO CONTROL OPERATION OF A LAUNDRY DRYER

This application is a U.S. National Phase application of PCT International Application No. PCT/EP2017/067862, filed Jul. 14, 2017, which is incorporated by reference herein.

FIELD OF THE INVENTION

The present invention relates to a method to control a laundry dryer, and in particular a laundry dryer having a first and a second interface.

BACKGROUND

It is known that it is possible to command appliances via external devices, such as home automation displays, remote controls and telecommunication devices such as smartphones and the likes.

In any of these devices, by means of an input system, e.g. displays, apps, touchpad, etc., a user may input a command which is transferred to the appliance. The device can be connected to the appliance either in a wireless manner or via a cable. The command therefore, either as an electric signal, or via a wireless signal in a telecommunication network, reaches the appliance, and in particular a control unit of the appliance, where it is "translated" in an action of the appliance itself. The command can be any, such as a command to start the appliance or to stop the same.

However, these devices from which the appliance can be commanded, generally are remote from the appliance itself. That is to say, the device from which the appliance can be for example started or stopped, are separate or separable from the appliance and therefore may be not in the same room or even building where the appliance is located. This fact may lead to security concerns. If the appliance is not "supervised", security aspects may become relevant, for example warnings emitted by the appliance may be unnoticed because they are not seen or heard, or the user is not capable to react being remote from the appliance.

SUMMARY OF EXEMPLARY EMBODIMENTS

There is therefore a need to control a laundry dryer so that the operations of the same, such as the drying cycle, can be correctly performed also when commanded remotely from the appliance, i.e. by means of a remote or portable control. Preferably, the above control does not increase the overall costs of the appliance.

According to a first aspect, the invention relates to a method to control operation of a laundry dryer, the laundry dryer comprising:

- a control unit having a memory in which instructions for a drying cycle, for a first working routine and a second working routine are stored;
- a first interface and a second interface, both adapted to transfer a user input command received at the first or second interface to the control unit for operating the laundry dryer;

the method including:

starting a drying cycle;

providing a user input command to the control unit through the first or the second interface to modify the drying cycle, wherein:

if the user input command is provided through the first interface then starting the first working routine;

if the same user input command is provided through the second interface then starting the second working routine which differs from the first working routine in at least one operational parameter set for operating the laundry dryer.

The laundry dryer of the invention may be preferably a laundry dryer or a laundry washer dryer.

The laundry dryer may comprise a casing preferably including a front wall, a rear wall, side walls and a base section or basement. The front wall may comprise a front top panel to command the functioning of the machine by the user. The casing defines the boundary between the internal or inner volume of the dryer and the exterior to the dryer. The basement is preferably divided in an upper and a lower shell. The basement preferably houses several components of the dryer.

Further, preferably, the casing includes a loading/unloading aperture closable by a door hinged to the casing, e.g. to the front wall in case of a front loading dryer, which is openable in order to introduce the laundry in a drum.

The drum is a chamber in which the load of laundry, e.g., clothes, or other items to be washed and/or dried are placed. The laundry is made of a given textile. The drum is adapted to rotate in a direction and in an opposite direction, reversing its rotation, for example driven by a motor, such as a variable speed motor in order to regulate the speed of rotation of the drum.

The laundry dryer further preferably includes a process air circuit connected to the drum and a heater device or generator which generates and circulates drying process air inside the drum, so as to continuously extract surplus moisture from the air issuing from the drum after flowing over the laundry. The drying process air therefore enters the drum, for example by means of a drum air inlet, and exits the drum by means of a drum air outlet. Preferably, said air outlet may be located at a peripheral edge of the loading/unloading opening on the casing.

In addition, the terms "upstream" and "downstream" are used in the present description and claims with respect to the direction of a main flow of the process air in the process air conduit.

The process air exiting the drum preferably enters the basement where the heating device is preferably present to heat and dehumidify the process air coming from the drum.

The heating device of the present invention includes preferably a heat exchanger. In an embodiment such a heat exchanger includes an air-to-air heat exchanger. In a different embodiment, the laundry dryer includes a heat pump having a condenser and an evaporator and the hot-air generator includes the heat pump. Alternatively, the heating device includes an electrical heater.

In case of a heat pump dryer, hot dehumidified air is fed into the drum, flowing over the laundry, and the resulting humid cool air exits the same. The humid air stream rich in water vapour is then fed into an evaporator of a heat pump, where the moist warm process air is cooled and the humidity present therein condenses. The resulting cool dehumidified air is then either vented outside the appliance in the environment where the latter is located or it continues in the closed-loop circuit. In this second case, the dehumidified air in the process air circuit is then heated up before entering again in the drum by means of a condenser of the heat pump, and the whole loop is repeated till the end of the drying cycle. Alternatively, environment air enters into the drum from the environment via an inlet duct and it is heated up by the condenser of the heat pump before entering the drum. The process air is preferably blown within the process air circuit by means of a process air fan for example a variable speed fan, driven by a motor. Preferably, the motor of the fan and the motor of the treating chamber are the same motor. Different circuits are known in the art in case of a washer-dryer.

The heat pump of the drying machine includes a refrigerant circuit in which a refrigerant can flow and which connects via piping a first heat exchanger or condenser, a second heat exchanger or evaporator, a compressor and a pressure-lowering device. The refrigerant is pressurized and circulated through the system by the compressor. On the discharge side of the compressor, the hot and highly pressurized vapour is cooled in the first heat exchanger, called the condenser, until it condenses into a high pressure, moderate temperature liquid, heating up the process air before the latter is introduced into the drying chamber. The condensed refrigerant then passes through the pressure-lowering device such as an expansion device, e.g., a choke, a valve or a capillary tube. The low pressure liquid refrigerant then enters the second heat exchanger, the evaporator, in which the fluid absorbs heat and evaporates due to the heat exchange with the warm process air exiting the drum. The refrigerant then returns to the compressor and the cycle is repeated.

In order to compress the refrigerant, the compressor preferably includes an electric motor which is commonly powered by a current, for example a current coming from the mains.

The present invention however is applicable not only to heat pump laundry dryer, but to any type of dryer.

The laundry dryer of the invention preferably includes a selector, for example operable by the user, with which a plurality of drying cycles can be alternatively selected. A laundry dryer generally includes a plurality of drying cycles each designed to treat laundry made of a specific textile type or composition, such as a cotton cycle at high temperature for cotton textile; permanent press, which generally refers to coloured garments and utilizes medium heat; a knits/delicate cycle is for delicate textiles which cannot withstand very much heat; the delicate cycle uses air slightly above room temperature to gently and slowly dry fragile garments, etc. Therefore, generally the cycle is selected depending on the type of textile to be dried.

Many different types of drying cycles can be present in the drying machine of the invention.

Each drying cycle can differ from the other drying cycles by a plurality of different settings, that is, a plurality of parameters for the operation of the laundry dryer. This means that selecting a given drying cycle implies that also a plurality of such parameters is selected. These parameters determine the way in which the laundry dryer operates during the drying cycle. The operating parameter for a drying cycle can include for example the temperature of the process air which flows inside the drum to dry the textile, the time duration of the cycle, the speed of revolution of the drum, the number of changes in direction of revolution of the drum, the degree of humidity at which the textile is considered to be dry and the cycle terminated, etc.

All these settings and the corresponding program lines for each cycle are for example included in a memory of the drying machine, for example in a control unit of the drying machine. Further, each drying cycle, although preferably not visible to the user, may include one or more settings for the heat pump operation.

Thus selecting a given drying cycle implies selecting a plurality of operational parameters for the functioning of the dryer.

Each drying cycle includes a drying phase, which is the phase in which the clothes and/or textile introduced in the drum are dried. Each cycle may include also other phases, such as a cooling phase after the main drying phase, in which the laundry is cooled before the user may access them. In the cooling phase, the temperature reached by the textile in the main drying cycle is reduced. Further, one or more of the drying cycles may include a pre-heating phase where the drum and other components of the drying machine are heated up in order to pre-warm the machine so that it reaches the optimal temperature to start the main drying phase.

The selection of a laundry drying cycle or program can be made in any possible way, for example by means of interfaces, as better detailed below. The laundry dryer thus includes a first and a second interface from which the selection of a program can be made. The selection can be made for example by means of a mechanical switch or a rotatable knob, by means of buttons, one per cycle, by means of a touch screen, etc.

Further, the selection can be performed by the user manually, by means of a remote control, i.e. a control which is separate or separable from the laundry appliance, or by means of a wireless command signal, automatically due to a pre-set timer, etc.

The selection of the cycle preferably depends on the type of clothes, garment, textiles, etc. inserted in the drum.

The control unit of the laundry dryer also includes, stored in the same memory as the drying cycles' programs or in a different memory, a first and a second working routine. Each working routine includes a set of instructions for the laundry dryer. Therefore, each working routine also defines a plurality of operational parameters for the laundry dryer, as the operational parameters defined by the selection of a drying cycle.

Selecting a working routine therefore sets a plurality of working or operational parameters of the laundry dryer.

In order to start a drying cycle, a laundry can be inserted in the drum of the laundry dryer. The dryer is then switched on and, once the selection of the drying cycle is performed, the drying cycle starts.

As mentioned, once started the laundry dryer retrieves all the information relative to the selected drying cycle from the memory in the control unit. The information relates to the operational parameters of the laundry dryer during execution of the drying cycle and the list of operations, also called sequence of instructions, to be performed by the laundry dryer during the drying cycle. However, it is possible according to the invention to vary the drying cycle, for example either changing the operational parameters of the same or changing the sequence of instructions defining the drying cycle. Changing the sequence of instructions may mean to change the temporal sequence of the instructions or the instructions themselves.

In order to perform this change to the selected drying cycle, the user needs to input a given user command to the laundry dryer so that the control unit becomes aware than "something" in the drying cycle needs to be changed.

The user input command can be inputted either in the first or in the second user interface. The user interfaces are both apt to receive such a user command and to transmit the same to the control unit of the laundry dryer. The user interface can be of any type. The user interface can be the control panel of the laundry dryer. In this case therefore, the user interface is located in a portion of the casing of the laundry dryer, for example in a top portion of the same close to the door opening and closing the drum. The user can input a user command by means of knobs, push buttons, touchscreen and similar devices. The user interface may be a display of a home automation network, connected to the laundry dryer by means of suitable dedicated cables. Further, the interface may be a remote control connected to the laundry dryer using an Infrared protocol to transmit signals. Alternatively or in addition, the user interface may be a smartphone, a tablet or the like connected to the laundry dryer via a telecommunication network. The interface and the laundry dryer may be connected via Internet.

First and second interface are preferably not only adapted to send signals to the control unit of the dryer, but also to receive signals from the control unit of the dryer. For example, a plurality of data could be received by the first or second interface regarding the functioning of the dryer. Warning signals could be received as well.

Regardless of the interface and the type of network connecting the interface and the dryer (the network can be physical, such as a cable, or wireless), the interface is adapted to send user input commands to the dryer via a network. The user input commands, as detailed above, can be inputted depending on the type of interface. That is, the user can input a command pressing a button in the control panel, performing a gesture on the screen in case of a smartphone, rotating a knob in a control panel, etc.

The laundry dryer of the invention can be commanded via two different interfaces. The first interface and the second interface may both send commands inputted by the user to the control unit to be executed.

To each user input command a list of effects is connected. That is, for each command which can be sent from the first or the second interface, a desired status of the dryer to be achieved is connected. This desired status may require one or more modifications to the drying cycle. The desired status includes a plurality of working parameters for the laundry dryer, that is, reaching a "status" of the laundry dryer means imposing a set of operational parameters to the laundry dryer. Each command refers to a desired status to be achieved and this status is defined by its list of operational parameters for the laundry dryer. Thus, for example, a command sent from the first or the second interface may be "pause", which refers of the status "pause the laundry dryer so that the drying cycle is interrupted". This status may include as set operational parameters the following: the process air fan switched off, drum stopped and heating device switched off.

Thus the desired status is obtained when the laundry dryer operational parameters are those required by the status itself. However, there are more operational parameters than those set by the desired status of the laundry dryer. These additional operational parameters may have any value. Again, as a further example, a command can be "start" in order to start operations of the laundry dryer. The status connected to this command is of "start the drying cycle in the laundry dryer" and it includes the following set of operational parameters: drum motor is switched on; process air fan is switched on; and the heating device is switched on. This list of operational parameters which are set for each status may be stored into the memory of the control unit, so that at each user input command the status can be read in the memory. If the list of set parameters is the same for a command sent from the first interface and for a command sent from the second interface, that is, if the two commands have as a target the same status, then the two commands are considered to be the same command.

In other words, two commands are the same if the status they refer to is the same, which in turn means that they put the same set of operational parameters to the same values.

Possibly, there are commands which may be inputted only from one of the two interfaces. For example, a special cleaning program for the laundry dryer itself may be selectable only from one of the two interfaces. Alternatively or in addition, a delay in the start of a drying cycle of more than a given number of hours may be selectable from only one of the two interfaces.

According to the invention, if the same command is sent via the first or the second interface, the result may be different, that is, after the execution of the command, the subsequent actions of the dryer may be different depending from which interface the command has been sent.

When the command has been inputted, then the desired status and the list of set operational parameters for such a status are retrieved from the memory of the control unit.

If the user input command is sent to the control unit of the dryer via the first interface, then the first working routine takes place. That is to say, as soon as the desired status is retrieved, then the set of operational parameters in the first working routine takes the listed values. The first working routine is for example a computer program saved in the memory of the control unit.

The actions listed in the first working routine may be several, or none, in the latter case the effect of the working routine on the drying cycle is none.

Thus a command (command_1) sent from the first interface implies that the first working routine (WR_1) defines a first plurality of values of operational parameters (OP_1) for the dryer and the selected status (S1) defines a second plurality of values of operational parameters for the dryer (OP_2). In other words:

$$\text{Command_1}=WR_1(OP_1)+S1(OP_2)$$

In case the command is sent via the second interface, then the second working routine takes place. That is to say, as soon as the desired status is retrieved, then the set of operational parameters in the second working routine takes the listed value. The second working routine is for example a computer program saved in the memory of the control unit.

The actions listed in the second working routine may be several, or none, that is, in the latter case the effect of the working routine on the drying cycle is none.

Thus a command (command_2) sent from the second interface implies that the second working routine (WR_2) defines a third plurality of values of operational parameters (OP_3) for the dryer and the selected status (S2) defines a fourth plurality of values of operational parameters for the dryer (OP_4). In other words:

$$\text{Command_2}=WR_2(OP_3)+S2(OP_4)$$

The two commands command_1 and command_2 are the same if S2(OP_4)=S1(OP_2)

Thus command_1 is considered to be equal to command_2 with $$\text{Command_1}=WR_1(OP_1)+S1(OP_2)$$

$$\text{Command_2}=WR_2(OP_3)+S1(OP_2)$$

From the above it is clear that, although the first and second command are the same because the desired status which is achieved is the same (the values of the set of operational parameters OP_2 reached by the laundry dryer are the same), values of a different set of parameters of the laundry dryer is different in the two cases (OP_3 is different from OP_1), which is due to the presence of the first and second working routine.

Preferably, the set of values of parameters OP_1 does not include any of the values of parameters OP_2.

Preferably, the set of values of parameters OP_3 does not include any of the values of parameters OP_2.

The first and the second working routine WR_1 and WR_2 are different one from the other. In this way, the subsequent values of the working parameters set for the laundry dryer are different (at least a value of a parameter is different, or different parameters are considered in the two lists) and depends on whether the command reaches the control unit via the first or second interface, that is at the end of command 1 the values of the working parameters set in the laundry dryer are equal to OP_1+OP_2, while at the end of command_2, the values of the parameters set in the laundry dryer are equal to OP_3+OP_2.

However, in both cases at least at the end of the first and of the second working routine, the status which has been forced in the laundry dryer by the command is obtained, that is, in both cases the dryer reaches the values of the set of parameters equal to OP_2. That is, regardless of the actions or phases performed during the first or the second working routine, the status of the machine connected to the command (status which is identical regardless from where the command has been sent) is achieved and thus a plurality of operational parameters are set in the drying machine.

However, the value of additional operational parameters of the laundry dryer, such as the values OP_1 (additional to those listed as set in the desired status, which are OP_2) at the end of the first working routine may be different from the value of the same operational parameters of the laundry dryer at the end of the second working routine, which are set equal to OP_3. For example if the command "pause" is sent, relating to the status "pause the laundry dryer", status which includes the parameter "the heating device is switched off", the heating device is stopped at least at the end of the first and second working routine in both cases (command sent from the first or the second interface). However other parameters values may be different, such as a speed of rotation of the process air fan, sensors whose signal needs to be detected, or a speed of rotation of the drum, and they do depends on the interface used to send the command.

The actions performed during the first and second working routine can be any as long as at least at the end of the first/second routine the desired status (that is the value of a list of operational parameters is set) is achieved.

The desired status can be achieved already at the beginning of the first or second working routine or in the middle of the same.

Thus, given the same command from the first or the second interface, the desired status of the laundry dryer is the same at the end of the first or second routine. However, there is at least another operational parameter of the laundry dryer, besides those set by the status, the value of which is different depending on whether the signal has been sent from the first or second interface and it depends whether the first or the second routine has taken place. This operational parameter can be any.

In this way, the same command may have different consequences on the following behavior of the laundry dryer, although the same desired status is obtained. Therefore, different phases can take place after the same command, such as a different first and second working routine. The fact of having different phases after the command, that is, after either the first or the second working routine, implies that at the end of the selected first or second routine, there is at least an operational parameter of the laundry dryer that would have had a different value if the other routine had been chosen. This in turn takes into account the fact that the same user command can be sent to the laundry dryer from very different interfaces, which can be geographically positioned in different places or they may be used by different users (such as professionals remotely operating the laundry dryer and the home users).

Preferably, the first interface is remote, i.e. separate or separable, from the laundry dryer. The laundry dryer preferably includes a casing. The first interface is preferably detached and placed remotely from the casing. Thus, first interface and laundry dryer do not share the same geographical location, but they are positioned remotely one from the other. The communication between the first interface and the dryer may be cabled (for example in a home automation network) or wireless. The distance between the first interface and the dryer can be any, however the protocol of transmission of commands from the interface to the dryer may change depending, among others, on this distance.

More preferably, said second interface is a portable communication end device adapted to receive and send data from/to the laundry dryer via a communication network. Preferably, the communication is wireless. A portable communications device may be a hand-held or wearable device. Commands may be inputted via buttons or a touch screen.

Preferably, said laundry dryer includes a casing and said second interface includes a control panel fixed to the casing. Generally, dryers include a control panel, for example having knobs, lights, buttons and a display to receive inputs for the operation of the dryer and to output information or warning signals regarding the functioning of the dryer. In this way, the method of the invention does not require big modifications of the existing dryers.

Preferably, the laundry dryer includes at least one of:

- a drum to house the laundry;
- a first motor to rotate the drum;
- a process air fan to blow process air in the drum;
- a second motor to rotate the process air fan;
- a process air heating device to heat the process air;
- a cooling device to cool the heating device;

and wherein the at least one operational parameter set for operating the laundry dryer includes:

- speed of the first or second motor;
- number of times in which the process air fan is switched ON or OFF per unit of time;
- duration of the drying cycle;
- duration of the first or second working routine;
- activation temperature of the cooling device to cool the process air heating device;
- heating power provided by the process air heating device;
- direction of rotation of the drum;
- number of reversals of the direction of rotation of the drum per unit of time.

Preferably, the dryer includes a drum which is rotated around an axis by means of a motor. Further, a fan blows the process air in a drying circuit which includes the drum. The fan is generally operated by a second motor, however often the motor of the drum and the motor of the fan coincide and a single motor drives both fan and drum. Further, the laundry dryer may include a heating device, such as a heat pump, a heat exchanger or an electrical heater to heat up the process air so that it can dry the laundry in the drum. The heating device, in order not to overheat, may include a cooling device which is preferably activated when the temperature of the heating device is above a given threshold. The operative parameter that differentiate the first and the second working routine may belong to the list of operative parameters for the functioning of any of the above components of the dryer. For example, the different operative parameter may be the speed of the first or second motor, and thus the speed of the drum and/or the fan for the process air. It may be the number of times in which the process air fan is switched ON or OFF per unit of time, changing the air flow per unit time of the process air in the drum and consequently also the temperature of the laundry. Further, it may include the duration of the drying cycle, which can be shorter or longer, in case for example the drying cycle is restarted after the first or second working routine has ended. The difference may be in the duration of the first or second working routine, one being longer or shorter than the other. The operational parameter may include the activation temperature of the cooling device to cool the process air heating device, that is, the temperature at which the cooling device is turned ON and starts cooling the heating device to avoid overheating. Further, also the heating power provided by the process air heating device to the process air may be different in the first and second working routine, so that also the duration of the routine may change. The drum may rotate either clockwise or counterclockwise. Being the direction of rotation connected also to the direction of rotation of the fan, in case a single motor is present, a difference in the direction of rotation of the drum between the first and the second working routine may lead to a difference in flow rate of process air in the drum. During the first or second working routine, the direction of rotation of the drum may change. The number of reversals of the direction of rotation of the drum per unit of time may also affect the overall flow rate of the process air in the drum.

Preferably, providing a user input command to modify the drying cycle includes interrupting the drying cycle by means of an interruption command. The user input command thus can be an interruption command. The interruption command interrupts the drying cycle, that is, the laundry dryer stops drying the laundry. The meaning of "interrupt" is the same as "pause" or "suspend", that is, the interruption may be a terminal interruption so that there is no resumption of the cycle and it is substantially equivalent to a "stop" command, or the drying cycle which has been interrupted may be later resumed and finished.

Preferably, the first working routine is a cooling phase. Thus, after the command of modifying the drying cycle has been sent, a cooling phase starts, where the laundry is cooled. This is in particular relevant in case the command has been an interruption command. In case of a tumble dyer that could be operated remotely, for example through a smartphone app, safety requirements are preferably observed. When the dryer is paused form a remote user (the drying cycle is interrupted), such as the case in which the first interface is the smartphone, a proper first working routine is selected to guarantee safe temperature limits similar to what it needed at the end of cycle. For example, regulations in some countries on tumble dryers may establish precise conditions for the air temperature at the end of the drying cycle. Any drying cycle where the air temperature exceeds a certain threshold preferably performs a cooling phase with reduced heating power in order to minimize the possibility of spontaneous combustion of the clothes load. This cooling phase requires the drum to be continuously rotated. At the end of the drum rotation of cooling phase drum outlet temperature has not to exceed the mentioned threshold. While pausing the machine though a command given on an interface on the dryer, such as when the second interface is the control panel, has not specific normative requirement, because the user is in front of the dryer in order to operate the control panel and could be ensure that nothing dangerous can happen, the situation is different when the appliance receives pause command form a remote system/user, when the first interface is remote from the dryer.

In this case, to reduce the risk of spontaneous combustion of the laundry, it is preferred that before stopping any operation, i.e. before switching off the dryer, the dryer may initiate a proper action to cool the appliance and the laundry in a way that drum outlet temperature is below the given threshold (as for final cooling phase at the end of the drying cycle).

Therefore, when the dryer receives a command, such as an interruption command, from the first interface which is preferably remote from the dryer, a cooling phase starts.

More preferably, the second working routine includes a phase different from the cooling phase which takes place when the user input command is inputted from the first interface. The second working routine starts when the command is inputted from the second interface. Preferably, the second interface is located in the same geographical location as the dryer. In this case there is no need of a cooling phase because the user can control the dryer's operations. Therefore, the parameter of interest is the Temperature of the laundry, and this temperature of the laundry is set equal or lower to a given value in the first working routine. In the second working routine, no parameter may be set equal to any value (i.e. there is no action which takes place due to the second working routine, or in other word the second working routine is null).

More preferably, if the user input command is provided through the first interface, starting a cooling phase after receiving the user input command, includes starting a cooling phase after receiving the user input command if a temperature value indicative of a temperature of the laundry is above a first threshold. Preferably, the cooling phase starts only if the temperature of the laundry is "high" enough. That is, if the temperature of the laundry is above a first threshold, then there is a cooling phase, otherwise, there is no such a phase after the execution of the user input command. Preferably, also the length of the cooling phase may vary depending on the temperature of the laundry. If the drying cycle had just started before the interruption command, for example, the temperature of the laundry is relatively low and therefore no cooling phase or a very short cooling phase may be needed in order to bring down the temperature of the laundry to an acceptable level. On the other hand, if the drying cycle was almost over or was started since a long while before the interruption command, a long cooling phase may be needed in order to lower the temperature of the laundry.

More preferably, the laundry dryer includes one or more:

a drum to house the laundry;

a first motor to rotate the drum;

a process air fan to blow process air in the drum;

a second motor to rotate the process air fan;

a process air heating device to heat the process air;

and wherein, if the user input command is provided through the second interface, the step of starting a phase different from the cooling phase which takes place when the user input command is inputted from the first interface, comprises:

starting a second cooling phase having at least one operational parameter set differently from the cooling phase that takes place when the user input command is provided through the first interface; or switching off one or more of the following:

the second motor of the process air fan;

the first motor of the drum;

the process air heating device;

till a cycle resumption command is inputted.

As mentioned, in case of a cooling phase which is started when the command is inputted in the first interface, if the same command is inputted in the second interface, a different phase takes place. This different phase can be still a cooling phase, but at least one of the operational parameters has a value reached by the laundry dryer at the end of this cooling phase which is different than the value reached at the end of the cooling phase activated by a command inputted from the first interface. Alternatively, no cooling phase starts if the command is inputted from the second interface. For example, the command is such that the status reached by the laundry dryer is achieved (i.e. the list of operational parameters reach the corresponding desired values) and then nothing changes (no other action takes place) till either the dryer is switched off, the duration time of the drying cycle is terminated or the drying cycle is resumed. The resumption command is a command that "cancel" the effect of the user input command which has changed the drying cycle. When the resumption command reaches the control unit of the laundry dryer, the drying cycle starts again, for example considering as starting values for the drying cycles the values of the operational parameters taken by the dryer at the moment in which the resumption command is received by the dryer.

Preferably, if the user input command is provided through the first interface, the step of starting a cooling phase after receiving the user input command includes:

continuing the cooling phase till a temperature value indicative of a temperature of the laundry is lowered below a second threshold; or continuing the cooling phase till a pre-determined time interval has elapsed.

The cooling phase which starts after the user input command has been sent to the control unit by means of the first interface has a certain duration. The duration of the cooling phase may depend on either the temperature of the laundry, so that, when the temperature of the laundry is lowered below a second threshold, then the cooling phase is terminated, or on time. In this second case, there can be either a "countdown" of the cooling phase, which—regardless of the temperature—terminates after a given number of minutes from the starting point, or it depends on the drying cycle. For example, the drying cycle may have a predetermined duration and therefore if this predetermined duration elapses while in the cooling phase, the cooling phase is terminated.

More preferably, the pre-determined time interval depends on one or more of:

type of textile of the laundry;

type of drying cycle selected;

duration of drying cycle;

drum motor operative parameters;

temperature of an environment in which the laundry dryer is located;

weight of the laundry;

moment in time in which the drying cycle has been interrupted;

geographical location of a user sending the command;

temperature of process air at the interruption.

Preferably, the laundry dryer includes:

a refrigerant circuit;

and wherein the at least one operational parameter set for operating the laundry dryer in the second cooling phase which is different from an operational parameter set for operating the laundry dryer in the cooling phase that takes place when the user input command is provided through the first interface includes one or more of:

a process air temperature;

duration of the cooling phase;

a refrigerant temperature;

speed of the drum;

temperature of the laundry.

As mentioned, a possible embodiment is such that a cooling phase starts after the user input command has been sent and received by the control unit, regardless whether the user input command has been sent via the first or second interface. In both cases a given status of the dryer is to be achieved which means that there is a list of operational parameters of the dryer which have to take a set value. However, the two cooling phases differ in at least in one operational parameter which is taken by the dryer and which does not belong to the list set by the desired status. This parameter may be the temperature of the process air which is blown in the drum, the duration of the cooling phase itself, the temperature of a refrigerant for example in a heat pump system, an angular speed of rotation of the drum or the temperature of the laundry.

Preferably, the laundry dryer includes a process air heating device to heat up process air to dry the laundry and wherein the step of starting a cooling phase after receiving the user input command if the interruption command provided through the first interface includes:

disabling the heating device.

The user input command may be an interruption command. In order to interrupt the drying cycle, the status includes as a set of values of operational parameters the fact that preferably the heating device is switched off.

Preferably, the drying cycle has a given duration and wherein the method includes the steps of:

resuming the drying cycle by means of a cycle resumption command, this step including:

calculating a $T_{spent}$ equal to the time elapsed between the beginning of the cycle and the time in which user input command to modify the drying cycle has been provided;

calculating a $T_{pause}$ equal to the time elapsed between the time in which the user input command to modify the cycle has been provided and the time in which the resumption command has been provided;

re-starting the drying cycle for a time which is a function of the drying cycle duration, $T_{spent}$ and $T_{pause}$.

The resumption command is a command that "cancels" the effect of the user input command which has changed the drying cycle. The parameters of the drying cycle which have been modified by the user input command are restored to their old values when the resumption command reaches the control unit of the laundry dryer. However, the drying cycle may take into account the new operational parameters of the dryer as new starting values. Thus, after the cycle resumption command, the drying cycle starts again. The resumed drying cycle may have a duration different than the original drying cycle, because already a percentage of the drying cycle duration has been already elapsed. Other parameters of the cycle may vary as well, for example the temperature of the process air, because the temperature of the laundry is now different than at the moment of interruption. In order to calculate the duration of the resumed drying cycle, the duration of the "modified drying cycle", which is the duration of the first or second working routine, is calculated. This is calculated as $T_{pause}$=time at which the resumption command has taken place−time at which the user input command has taken place Also the time in which the drying cycle was on going before the user input command is calculated:

$T_{spent}$=time at which the user input command has taken place−time of the beginning of the drying cycle Thus the remaining duration $T_{remaining}$ is calculated as $$T_{remaining}=T_{duration}-f(T_{pause},T_{spend})$$

Where $T_{duration}$ is the original total duration of the drying cycle and "f" means "function of".

Preferably, the laundry dryer includes:

a process air heating device including a heat pump system having a refrigerant circuit in which a refrigerant can flow, said refrigerant circuit including a first heat exchanger where the refrigerant is cooled off, a second heat exchanger where the refrigerant is heated up, a compressor to pressurize and circulate the refrigerant through the refrigerant circuit, and a pressure-lowering device; said first and/or second heat exchanger being apt to perform heat exchange between said refrigerant flowing in said refrigerant circuit and said process air;

a compressor fan adapted to blow air towards the compressor;

and wherein the step of starting a cooling phase after receiving the user input command if the user input command is provided through the first interface includes:

switching on the compressor fan to blow air towards the compressor during the cooling phase.

Preferably, the dryer is a heat pump dryer. In a heat pump dryer, a compressor fan is often present in order to cool the compressor and avoid overheating. Preferably, in the cooling phase, the compressor fan is activated to cool down the compressor. For example, a temperature at which the compressor fan activates may be lowered.

Preferably, the laundry dryer includes:

a selector adapted to select alternatively one of a plurality of drying cycles;

and wherein the method includes:

selecting a drying cycle among the plurality; and the step of starting a first working routine after receiving the user input command if the user input command is provided through the first interface includes:

selecting one or more operational parameters of the first working routine as a function of the selected drying cycle.

Preferably, the laundry dryer includes:

a selector adapted to select alternatively one of a plurality of drying cycles;

and wherein the method includes:

selecting a drying cycle among the plurality; and the step of starting a second working routine after receiving the user input command if the user input command is provided through the second interface includes:

selecting one or more operational parameters of the second working routine as a function of the selected drying cycle.

Operational parameters of the drying cycle may vary from one cycle to the others. For example, the temperature of the process air in a cotton drying cycle is generally higher than the same temperature in a delicate or synthetic cycle. Therefore, also the operational parameters of the first working routine may depend on the selected drying cycle. The same applies to the second working routine.

Preferably, the laundry dryer includes:

a selector adapted to select alternatively one of a plurality of drying cycles;

each drying cycle of said plurality being defined by a plurality of operational parameters;

and wherein the method includes:

selecting a drying cycle among the plurality; and the step of starting a first working routine after receiving the user input command if the user input command is provided through the first interface includes:

keeping one or more operational parameters of the drying cycle unchanged during the first working routine.

Preferably, besides the first working routine, all the other parameters of the drying cycle which has been modified are kept unchanged. Therefore, if with the drying cycle a plurality of parameters had been set, such as for example the temperature of the process air, or the speed of the drum, if they have not been modified by the user input command or by the first working routine, they remain unchanged.

More preferably, the laundry dryer includes one or more of:

a drum;

a motor rotating the drum;

and said one or more operational parameters which are kept unchanged comprises:

motor parameters while rotating the drum;

drum speed;

number of reversal of rotation of the drum per unit time;

flow rate of process air in the drum.

Preferably, the parameters which are kept unchanged are those relating to the process air flow in the drum.

Preferably, the laundry dryer includes a drum and wherein, during the step of starting a cooling phase after receiving the user input command if the user input command is provided through the first interface, one or more of the following operational parameters of the cooling phase are determined:

drum speed;

number of reversal of rotation of the drum in a time unit;

direction of rotation of the drum.

Preferably, the parameters which determines the type of cooling phase are those relating to the process air flow in the drum.

Preferably, the first interface includes one or more of:

personal computer;

smartphone;

tablet;

a memory storage having a computer program stored therein.

Preferably, the first interface is remote, i.e. separate or separable, from the casing of the laundry dryer. A program or app to control the laundry dryer may be installed in a plurality of devices.

Preferably, the first and second motor are the same motor. Advantageously, the motor of the drum and the motor of the process air fan are the same motor. A single motor therefore may drive both elements, saving space inside the basement and reducing costs.

BRIEF DESCRIPTION OF THE DRAWINGS

Reference is made in detail to preferred embodiments of the invention, examples of which are illustrated in the accompanying figures, where.

DETAILED DESCRIPTION OF EXEMPLARY EMBODIMENTS

Figure 1:
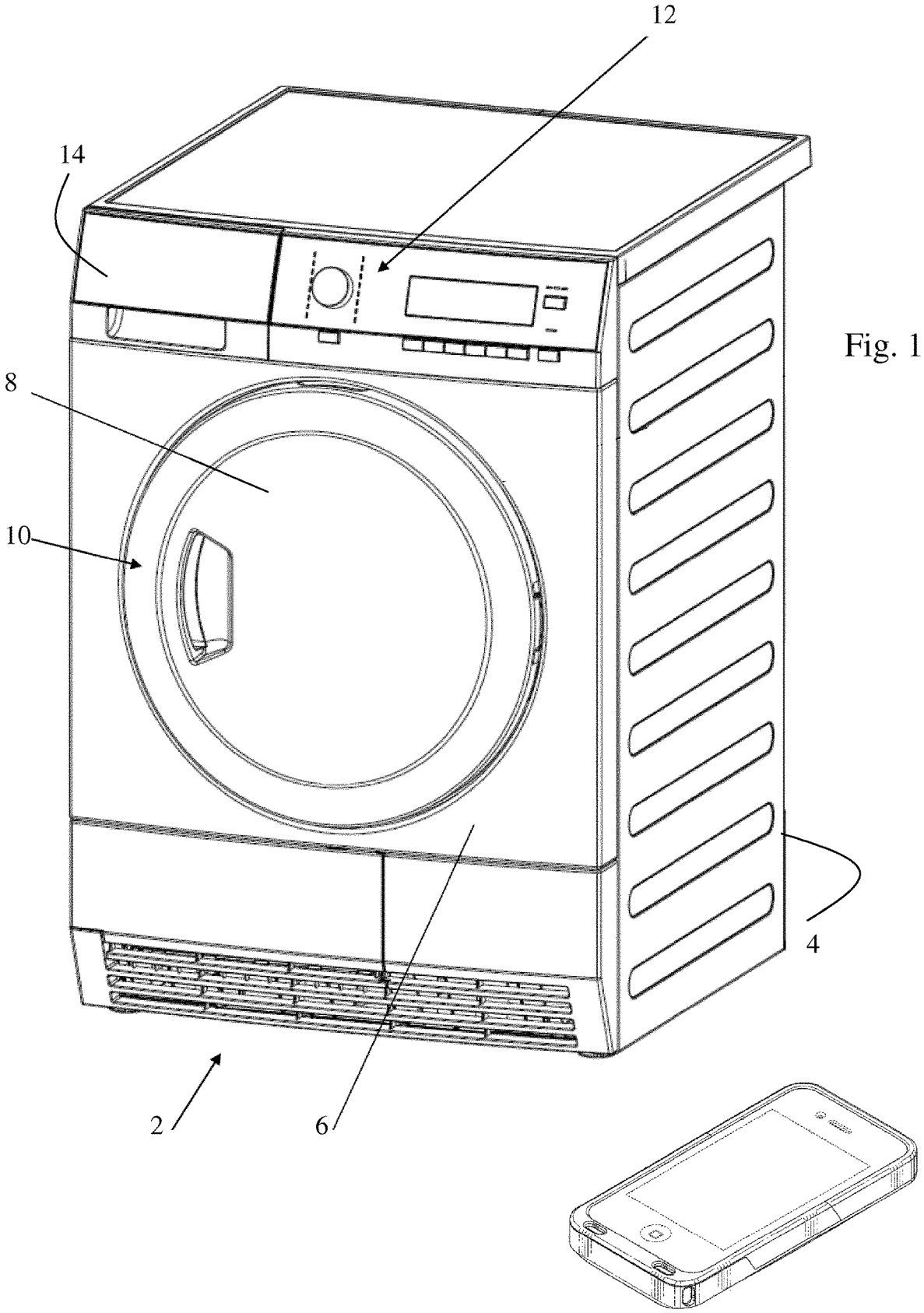
FIG. 1 is a perspective view of a drying machine according to the invention.

FIG. 1 shows a perspective outer appearance of an exemplary laundry dryer 2. In this embodiment, the laundry dryer is a laundry dryer only, but in alternative embodiments the dryer function according to the control method is implemented by a laundry washer-dryer in which the rotatable drum is arranged in a tub and which provides a washing arrangement including (for example) a detergent dispenser, a heater for heating wash liquid and a drain pump for draining out of the liquids.

As shown in FIG. 1, the laundry dryer 2 has an outer housing 4 or cabinet including a front wall 6. Further, the laundry dryer 2 includes a drum 16, where the laundry is positioned in order to be dried. At the front wall 6 a loading opening 8 is provided which is closed by a door 10, to access the drum 16. In the depicted embodiment, the laundry dryer is a front-loading laundry dryer having a horizontal drum rotation axis, but in alternative embodiments the drum may be inclined relative to the horizontal and vertical directions, or the dryer may be a vertical rotation axis dryer in which the drum rotates around a vertical axis and where top-loading is provided.

The laundry dryer is connected to a first interface 100, in the present case a smartphone, which can send user input commands to the laundry dryer 2. The connection may be a connection according to the 4G standard or via the internet. On the smartphone an application (App) may be installed in order to send commands to the laundry dryer 2.

The laundry dryer 2 includes a second interface, a control panel 12, arranged at the upper region of the front wall 6 and a condensate drawer 14 in which the condensate collected from drying is stored until removal by the user.

Figure 4:
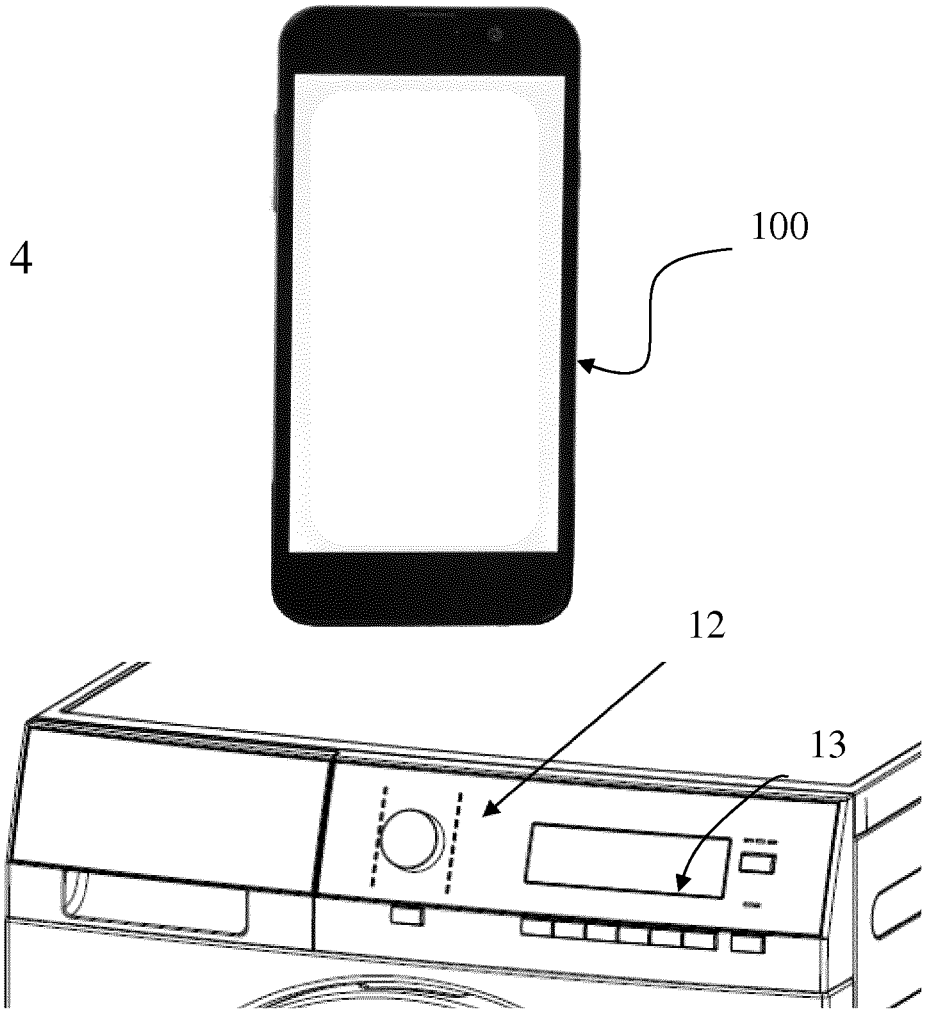
FIG. 4 is an enlarged view of a detail of the drying machine of FIG. 1.

Both first and second interface can be operated by a user, for example by manual control, in order to send commands to the laundry dryer. An enlarged view of the first and the second interface 100, 12 is given in FIG. 4.

Figure 2:
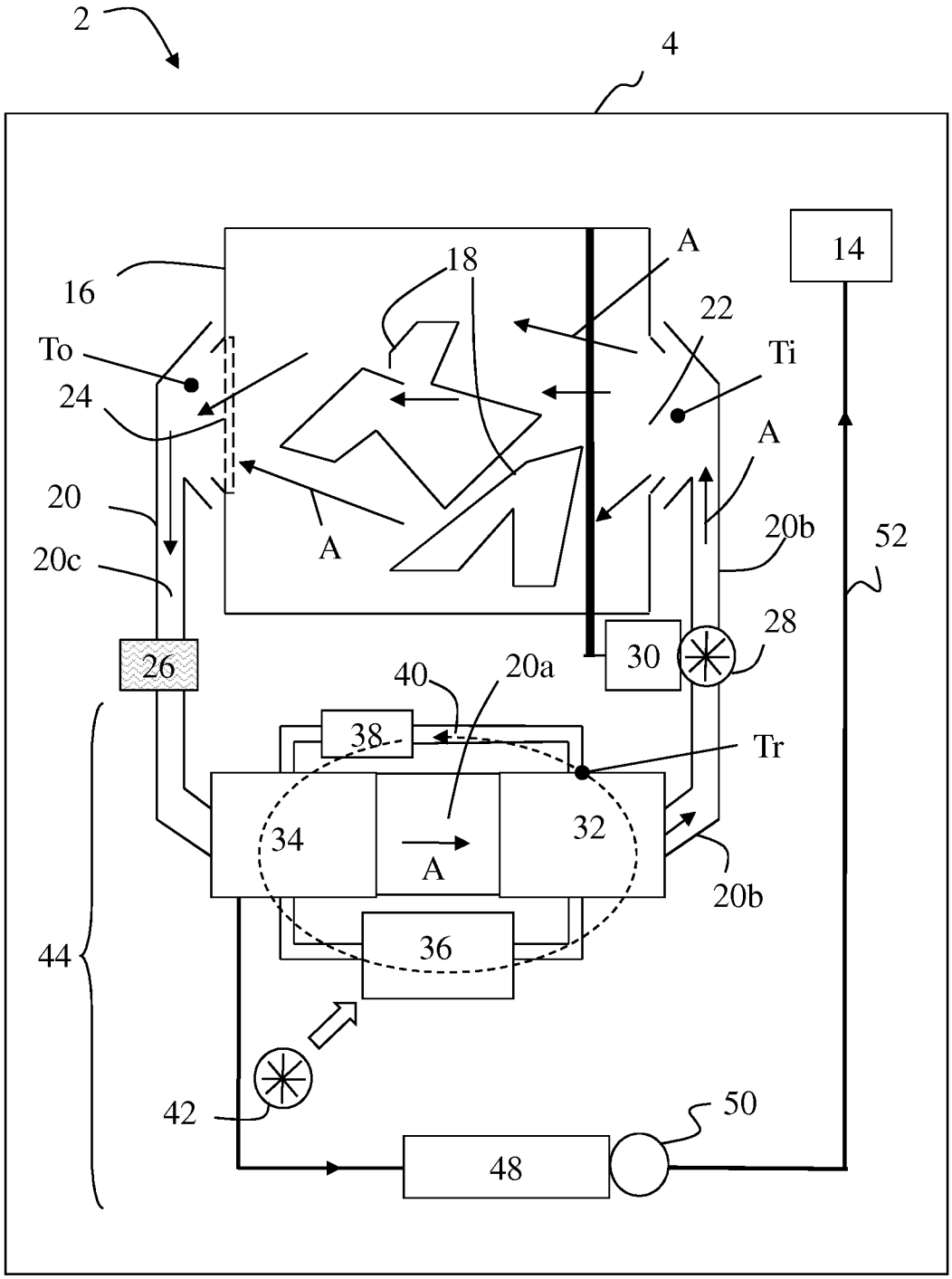
FIG. 2 is a schematic overview of some components of the drying machine of FIG. 1.

In the schematic diagram of components shown in FIG. 2, the drum 16 is arranged inside the housing 4, in which laundry 18 is received. The flow of process drying air A is indicated by the arrows, wherein the drying air A leaves the drum 16 at an outlet 24 and enters a process air channel 20 at the front channel 20*c*. By the front channel 20*c* the process drying air is guided through a fluff filter element 26 towards a second heat exchanger 34 and a first heat exchanger 32. The first and second heat exchangers 32, 34 are arranged in a battery channel 20*a* of the process air channel 20. The first heat exchanger 32 is a condenser which heats the process drying air and the second heat exchanger 34 is an evaporator which cools the process drying air for humidity removal in form of condensed water.

The process drying air leaving the first heat exchanger 32 is entering a rear channel 20*b* in which a drying process air fan 28 is arranged which conveys the drying air. The process air fan 28 is driven by a motor 30, which preferably at same time drives the rotation of the drum 16. However two different motors can be provided as well. The rotation of the drum 16 can be in one direction and also in the opposite direction, that is, reversing the rotation of the drum is possible in the laundry dryer operation, by opportunely driving the drum driving motor. In the depicted embodiment, a belt driven by the motor 30 is wound around the drum mantel for driving the fan. In the depicted embodiment, in which the single motor 30 drives the process air fan 28 as well as the drum 16, the drum and process air fan 28 are driven in a synchronous manner according to the gear ratio. Preferably, the speed of the drum and/or the process air fan is adjustable. Synchronous rotation of the drum includes a forward and backward rotation according to the motor forward and backward rotation, so that the direction of rotation of the drum can also be changed, from a forward to a backward or vice versa. As an example, the fan speed is identical to the motor speed as the process air fan is arranged on an axis of the motor 30, while via the belt the rotation of the motor is gear-reduced in an exemplary ratio of motor rotation speed/drum rotation speed of 50:1.

The first and second heat exchangers 32, 34 are part of a heat pump system 44 which further comprises an expansion device 38 and a compressor 36. In the heat pump system 44 a refrigerant loop 40 is formed, wherein the refrigerant pumped by the compressor 36 passes first the condenser 32, is forwarded to the expansion device 38 from where it expands into the second heat exchanger 34 and from where it is sucked into the compressor 36. Heat can be removed from the heat pump system (in addition to the heat deposited in the drying air and laundry for drying the laundry) by activating a compressor cooling fan 42 which provides a flow of cooling air from the outside of the cabinet 4 towards the outer surfaces of the compressor 36. The compressor cooling fan can be activated, that is, it can start blowing air against the compressor, for example above a given compressor temperature, and/or it may be deactivated, that is, it may stop blowing air against the compressor, for example below a given compressor temperature. In addition, the flow rate of the air moved by the compressor cooling fan 42 may be varied as well. After passing the compressor 36, the cooling air blown by the compressor cooling fan 42 is exhausted out of the cabinet 4.

The condensate that is formed at the evaporator 34 flows down and is collected in a condensate collector 48. From the condensate collector 48 the condensate is pumped by a draining pump 50 through a drain conduit 52 into the condensate drawer 14 from where it can be removed by the user as mentioned above. Preferably, in the condensate collector 48, the level of water can be measured by means of a level sensor and/or the temporal gradient of a level of water removed from the outdoor textile to be dried and collected can be measured as well.

One or more of the following can be present in the laundry dryer as well: at the outlet 24 of the drum 16 a temperature sensor, for example a thermocouple, is provided which detects the outlet temperature To of the drying air. At the inlet 22 of the drum 16 another temperature sensor, for example a thermocouple, is provided which detects the inlet temperature Ti of the drying air. At the outlet of the condenser 32 a temperature sensor is provided which detects the refrigerant temperature Tr at this position. Inside the drum, electrodes may be present as well to determine the degree of humidity Hum of the laundry when it contacts the electrodes, for example by means of a resistivity measurement.

Figure 3:
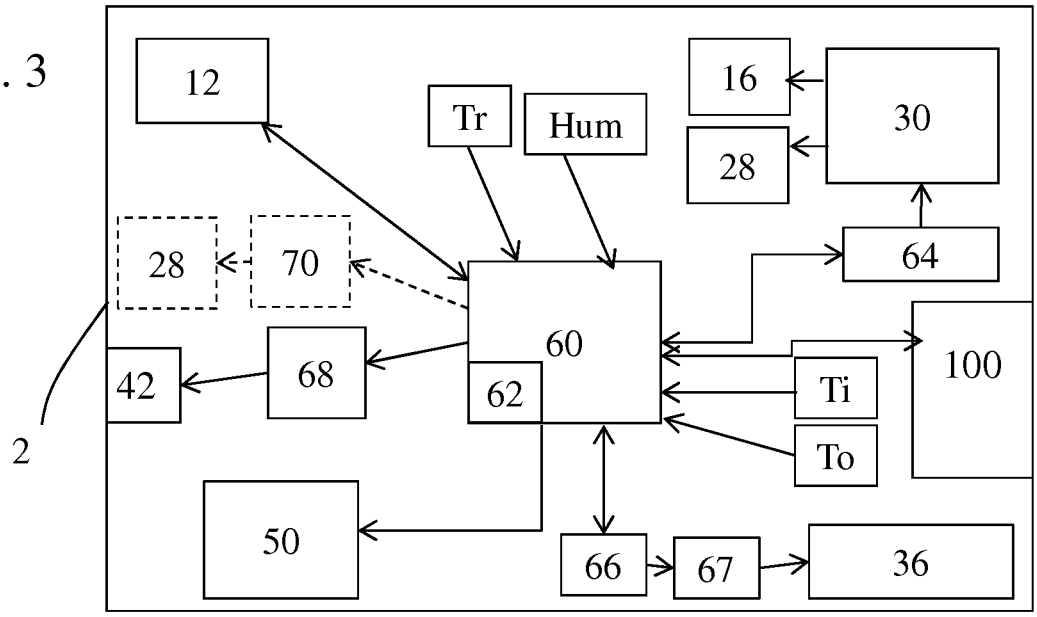
FIG. 3 is a block diagram depicting some of the components of the drying machine of FIG. 1 providing signals to a control unit and/or being controlled by the control unit.

FIG. 3 is a block diagram of components of the dryer 2 that interact for enabling a control unit 60 to control the drying operations or programs. The control unit 60 has a memory 62 in which program parameters and look-up tables are stored such that the control unit, by retrieving corresponding data from the memory 62, can control different basic drying programs preferably under conditions as set by the user via option selectors at the control panel 12. The user can select a program cycle among a list of different program cycles. The selection can be performed by means of a selector 13 in the panel 12. Alternatively, the program cycle can be selected via smartphone 100. Such user-settable options are for example: the type of drying cycle (cotton, delicate, outdoor, etc.), the final drying degree, the load of the laundry loaded by the user and inputted by him/her, the type of laundry, the duration of drying, an energy option, etc.

In the memory 62 a database is present in which to each of a plurality of commands which can be sent from the first or the second interface a status is associated. Further, to each status a plurality of set parameters identifying the status is associated as well.

For example, a command "pause" can be sent from the first or the second interface. The command "pause" identifies the status "interruption of the drying program" and it is defined by the following parameters (OP_2):

Heat pump switched off.

Process fan switched off.

Drum stopped (not rotating).

Optionally, the fan of the compressor may be switched on or off depending of the cycle and/or the temperature Further, to each command, a first and a second working routine are associated. The first routine is associated to the command if the command is sent via the first interface (smartphone 100), and the second working routine is associated to the same command if the command is sent via the second interface (control panel 12).

For example, to the command "pause", the following working routines are associated:

First working routine: cooling phase (i.e. a plurality of parameters that implies the performance of a cooling phase);

Second working routine: zero (no parameter is set, therefore, no parameter is modified from the setting given by the drying cycle).

Figure 5:
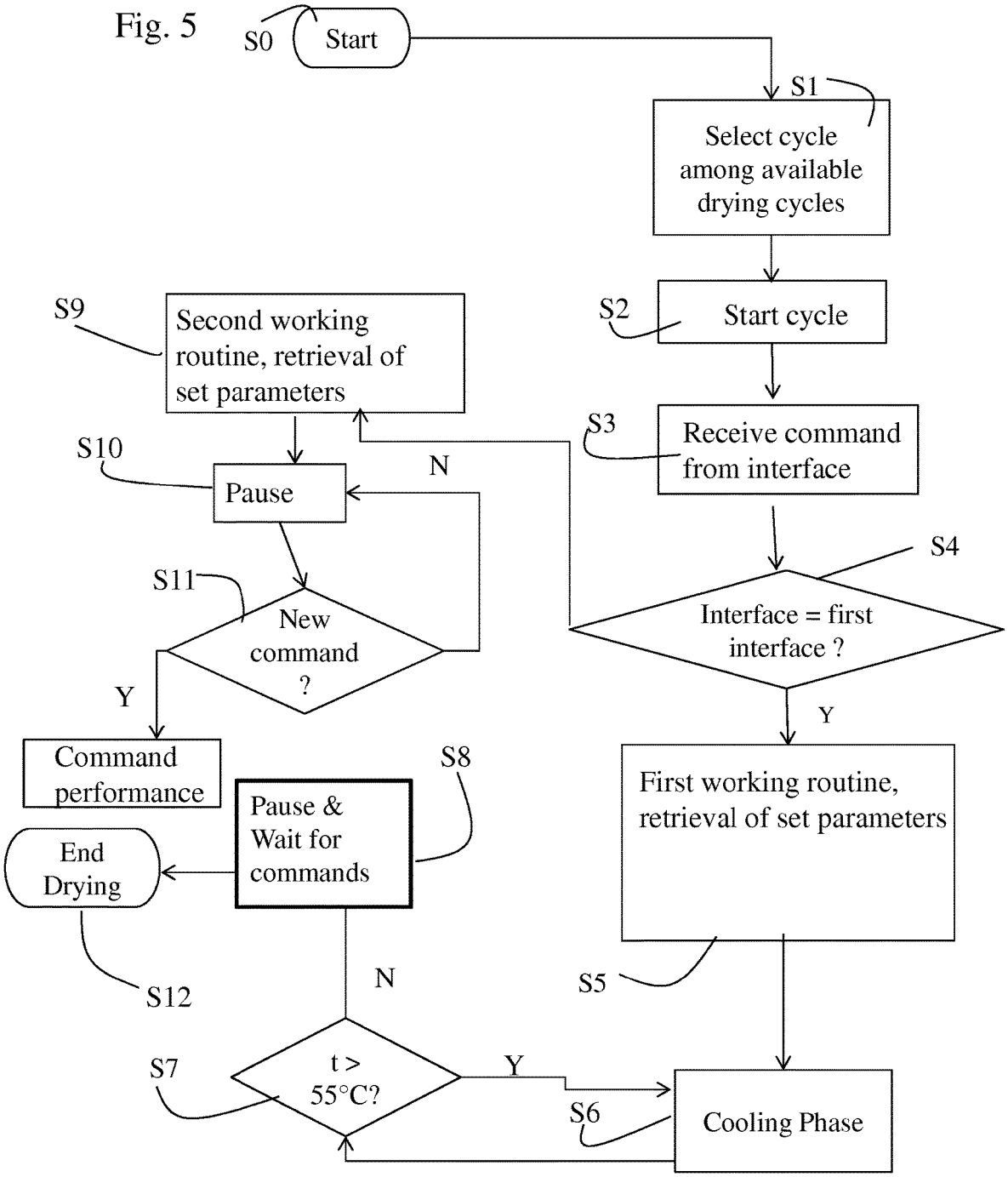
FIG. 5 is a flow chart of the method of the invention.

With now reference to FIG. 5, the dryer 2 is switched on in step S0 and a drying cycle is selected among those selectable by the first or second interface S1.

In any selected drying cycle, the control unit 60 sends control signals to a drum motor inverter 64 and may receive operation parameters therefrom. The drum motor inverter 64 supplies the power to the motor 30 driving the drum 16 and the drying air fan 28. The control unit 60 may send control signals to a compressor motor inverter 66 and may receive operation parameters therefrom. The compressor motor inverter 66 powers a compressor motor 67 for driving the compressor 36. Further, the control unit 60 may control the draining pump 50, a motor 68 for driving the compressor cooling air fan 42 and optionally, if a separate motor 70 is provided for the drying air fan 28, the drying air fan motor 70. The command signals sent by the control unit 60 depend on the specific settings of the specific program (drying cycle) selected.

The settings of the drying cycle of the selected programs are stored in the memory 62 and they may relate to one or more of: a frequency of the reversion of rotations of the drum 16 during the drying cycle, a speed of the process or drying air fan 28, the speed of the drum 16, the heat pump operation parameters.

The selected drying cycle starts, S2. Preferably, during the drying cycle, the control unit 60 monitors not only the signals coming from the motor 30 or its inverter, the compressor cooling fan 42, the compressor motor inverter, the process air fan 28, etc., but also it preferably further monitors the signals coming from one or more sensors, for example it may receive the signals from the sensors for the refrigerant temperature Tr, or for the inlet temperature Ti of the drying air, or for the outlet temperature To of the drying air, or the conductivity measurements Hum made by the electrodes in the drum 16, or the level of water in the condensate collector 48 and/or the temporal gradient of a level of water removed from the outdoor textile to be dried and collected can be measured as well, or relative to the number of activations of the draining pump 50 of the condensate collector 48.

A command is sent via the first 100 or the second interface 12 to the control unit 60. The command may be a "pause command", and it is received by the control unit S3. In the control unit 60, in particular in the memory 62, the status connected to the command is retrieved and it is determined whether the command has been sent via the first or the second interface, S4.

If the command "pause" has been sent via the smartphone 100, the instructions relating to the command, i.e. the operational parameters set by the status, are retrieved from memory 62, S5. The first working routine is a cooling phase S6. Therefore, the operational parameters set by the working routine and the operational parameters set by the status are both fulfilled at the end of the first working routine.

At the end of the cooling phase, the set operational parameters determined by the command "pause" are fulfilled. The cooling phase terminates when the temperature of the laundry is below 55° C., S7, or after a predetermined operation time. After the end of the cooling phase, the laundry dryer reaches the status of "pause" and waits for an additional command, for example a resumption command S8. If a resumption command is received, the drying cycle resumes and, if no other command "pause" is given, the cycle prosecute until it ends. To avoid the appliance to remain paused indefinitely, it can be provided that the drying cycle ends after a predetermined "pause" time is elapsed (S12). Alternatively, the cooling phase ends when a new command, like a cycle resuming command, is received while the cooling phase is operating (see the next embodiment of FIG. 6).

In case the command "pause" has been sent via the control panel 12, the instructions relating to the command, i.e. the operational parameters defining the status, are retrieved from memory 62, S9, and the second working routine does not add any new value to the parameters. Therefore, substantially "immediately", the set operational parameters determined by the command "pause" are fulfilled (S10). The "pause" status terminates if an additional command is received, S11. In that case the given command is performed. To avoid the appliance to remain paused indefinitely, it can be provided that the drying cycle ends after a predetermined "pause" time is elapsed.

Figure 6:
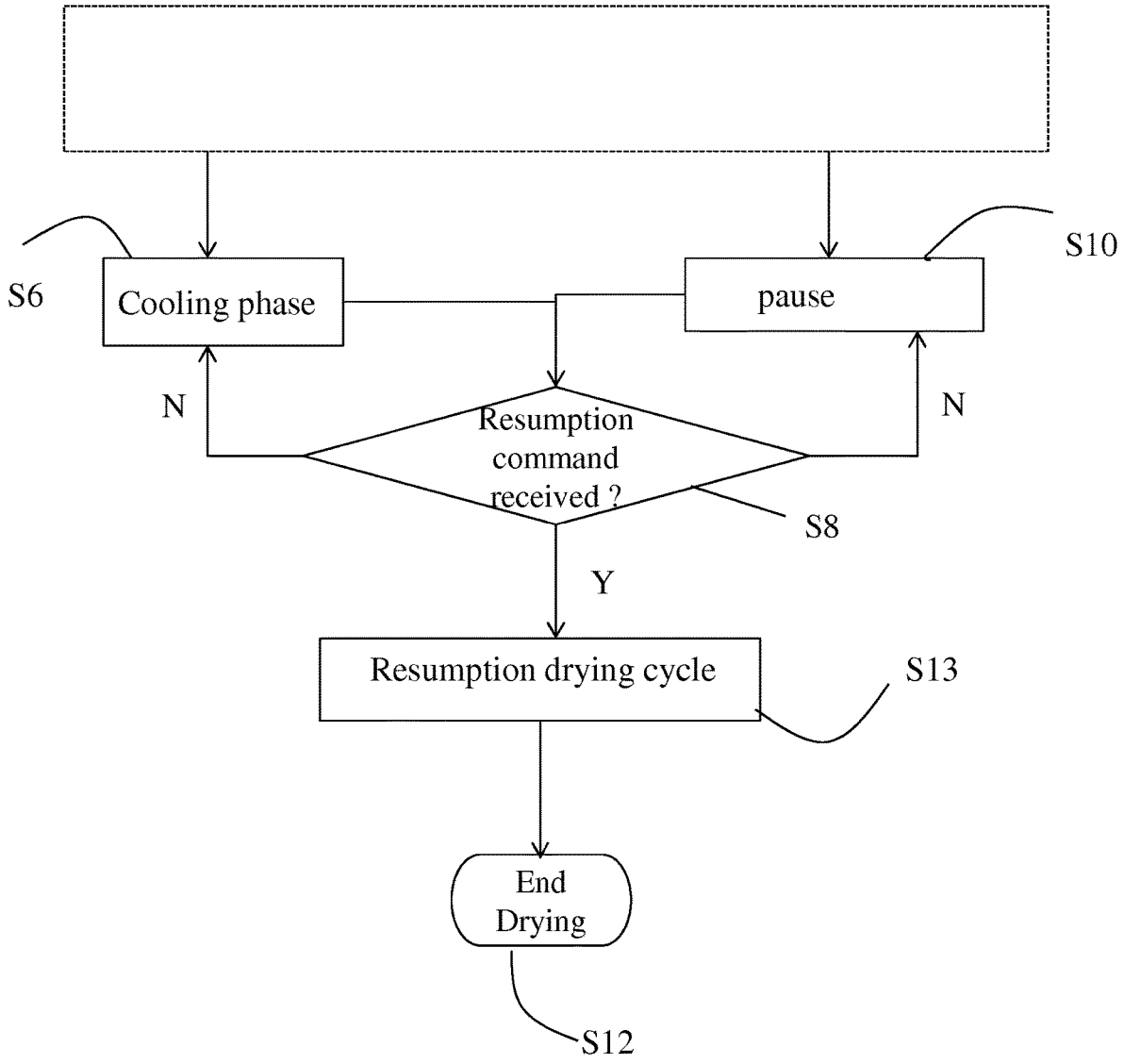
FIG. 6 is a flow chart of an additional embodiment of the method of the invention.

The embodiment depicted in FIG. 6 is similar to that of FIG. 5, however a cycle "resuming" command, inputted either from the first or the second interface, is received by the control unit 60. Therefore, the drying cycle is resumed.

In FIG. 6, only the portion of the flow diagram after the beginning of the first and/or second working routine is shown, the remaining of the flow diagram being identical to that of FIG. 5.

In this case, a resumption command may be received and this is checked in phase S8. In case the cycle resumption command is received, then the drying cycle starts again S13.

For example, the drying cycle may start again from the beginning, using as starting values the actual condition of the laundry, for example its humidity value. Preferably, the drying cycle remains the one selected from the beginning by the user, that is, for example the type of fabric indication and the desired level of humidity at the end of the cycle. The cycle ends as usual depending on the level of humidity of the laundry, that is, if the humidity level is below a certain threshold, then the cycles ends S11.

Alternatively, in a drying cycle which has a fixed duration, which is a cycle that terminates depending not on the humidity of the laundry but only on a given elapsed time, the remaining drying cycle duration after the "resumption command" has been sent preferably depends on the moment in time at which the pause command has been sent, and also on the moment in time at which the resumption command has been sent. For example, if the pause command has been sent substantially at the beginning of the drying cycle, substantially no drying has been performed, thus the drying duration after resumption is preferably substantially the full drying cycle duration. Preferably, if the pause command has been sent substantially at the end of the drying cycle, after resumption only a relatively small amount of time is needed to complete the drying. Preferably, if the resumption command is sent shortly after the pause one, substantially no changes to the total duration of the cycle are made.

In case such a resumption command is not received, the first or second working routine terminates as described according to the embodiment depicted in FIG. 5.

The invention claimed is:

1. A method to control operation of a laundry dryer comprising a control unit having a memory in which instructions for a drying cycle, a first working routine and a second working routine are stored, a first interface and a second interface, the first interface and the second interface being adapted to transfer a user input command received at the first interface or the second interface to the control unit for operating the laundry dryer, wherein the method comprises:

starting a drying cycle;

receiving a user input command to the control unit through the first interface or the second interface to modify the drying cycle, wherein:

upon receiving the user input command through the first interface, starting the first working routine; and upon receiving the user input command through the second interface, starting the second working routine which differs from the first working routine in at least one operational parameter set for operating the laundry dryer.

2. The method according to claim 1, wherein the first interface is remote or separate from the laundry dryer.

3. The method according to claim 2, wherein the first interface is a portable communication end device adapted to receive and send data from/to the laundry dryer via a communication network.

4. The method according to claim 2, wherein the laundry dryer comprises a casing and the second interface comprises a control panel fixed to the casing.

5. The method according to claim 1, wherein the at least one operational parameter set comprises:

a speed of a drum motor;

a speed of a process air fan motor;

a number of times in which the process air fan is switched ON or OFF per unit of time;

a duration of the drying cycle;

a duration of the first or second working routine;

an activation temperature of the cooling device to cool a process air heater;

a heating power provided by the process air heater;

a direction of rotation of a laundry drum; or a number of reversals of the direction of rotation of the laundry drum per unit of time.

6. The method according to claim 1, further comprising issuing an interruption command to interrupt the drying cycle upon receiving the user input command to modify the drying cycle.

7. The method according to claim 1, wherein the first working routine comprises a first cooling phase having a first set of cooling phase operational parameters.

8. The method according to claim 1, wherein, upon receiving the user input command through the first interface, starting a first cooling phase if a temperature value indicative of a temperature of the laundry is above a first threshold.

9. The method according to claim 7, wherein the second working routine comprises, until a cycle resumption command is received, either:

starting a second cooling phase having at least one operational parameter set differently from the first set of cooling phase operational parameters; or switching off one or more of:

a process air fan motor, a drum motor, and a process air heater.

10. The method according to claim 8, further comprising continuing the first cooling phase until:

a temperature value indicative of a temperature of the laundry is lowered below a second threshold; or a pre-determined time interval has elapsed.

11. The method according to claim 10, wherein the pre-determined time interval is selected based on one or more of:

a type of textile of the laundry;

a type of drying cycle selected;

a duration of a drying cycle;

one or more drum motor operative parameters;

a temperature of an environment in which the laundry dryer is located;

a weight of the laundry;

a moment in time in which the drying cycle has been interrupted;

a geographical location of a user sending the command; and a temperature of process air at a time of the interruption.

12. The method according to claim 8, wherein the second working routine comprises starting a second cooling phase having at least one operational parameter set differently from the first set of cooling phase operational parameters, and wherein the at least one operational parameter comprises one or more of:

a process air temperature;

a duration of the second cooling phase;

a refrigerant temperature of a refrigerant circuit;

a rotation speed of a laundry drum; and a temperature of the laundry.

13. The method according to claim 7, wherein the first set of cooling phase operational parameters includes disabling a process air heater.

14. The method according to claim 1, wherein the drying cycle has a predetermined duration, and wherein the method comprises, upon receiving a cycle resumption command:

calculating a $T_{spent}$ equal to the time elapsed between a beginning of the drying cycle and the time at which the user input command was received;

calculating a $T_{pause}$ equal to the time elapsed between the time at which the user input command was received and a time at which the cycle resumption command was received; and re-starting the drying cycle for a time which is a function of the predetermined duration, $T_{spent}$ and $T_{pause}$.

15. The method according to claim 7, wherein the laundry dryer further comprises a process air heating device including a heat pump system having a refrigerant circuit in which a refrigerant can flow, the refrigerant circuit including a first heat exchanger where the refrigerant is cooled off, a second heat exchanger where the refrigerant is heated up, a compressor to pressurize and circulate the refrigerant through the refrigerant circuit, and a pressure-lowering device, and the first and/or second heat exchanger is configured to perform heat exchange between the refrigerant flowing in the refrigerant circuit and the process air, and a compressor fan configured to blow air towards the compressor; and wherein the first cooling phase comprises switching on the compressor fan to blow air towards the compressor during the first cooling phase.

16. The method according to claim 1, wherein the laundry dryer includes a selector adapted to select alternatively one of a plurality of drying cycles and the drying cycle comprises a selected one of the plurality of drying cycles; and wherein the method comprises selecting the first working routine as a function of the selected one of the plurality of drying cycles.

17. The method according to claim 16, wherein the selected one of the plurality of drying cycles comprises a first set of drying cycle operating parameters and the first working routine comprises a second set of drying cycle operating parameters, and wherein one or more of the second set of drying cycle operating parameters are the same as the first set of drying cycle operating parameters.

18. The method according to claim 17, wherein the one or more of the second set of drying cycle operating parameters that are the same as the first set of drying cycle operating parameters includes one or more of:

laundry drum motor working parameters;

laundry drum speed parameters;

a number of reversals of rotation of the laundry drum per unit time; and a flow rate of a process air in the laundry drum.

19. The method according to claim 7, wherein the first working routine comprises:

determining, for the first cooling phase: a laundry drum speed, a number of reversals of rotation of the laundry drum per unit time and a direction of rotation of the laundry drum; and performing the first cooling phase according to the determined laundry drum speed, number of reversals of rotation of the laundry drum per unit time and direction of rotation of the laundry drum.

20. The method according to claim 1, wherein the first interface includes one or more of a personal computer, a smartphone, a tablet or a non-transient memory storage having a computer program stored therein.

21. A laundry dryer comprising:

a control unit having a memory in which instructions for a drying cycle, for a first working routine and a second working routine are stored; and a first interface and a second interface, both adapted to transfer a user input command received at the first or second interface to the control unit for operating the laundry dryer;

wherein the control unit comprises a processor having non-transiently stored instructions to perform the method according to claim 1.

* * * * *